United States Patent [19]

Bein

[11] 4,110,937

[45] Sep. 5, 1978

[54] HOLDING MEANS FOR GEM STONES

[76] Inventor: Kenneth E. Bein, 2518 Last Ave., Kingman, Ariz. 86410

[21] Appl. No.: 818,548

[22] Filed: Jul. 25, 1977

[51] Int. Cl.[2] ..... B24B 13/00; B24B 7/00

[52] U.S. Cl. ..... 51/229; 51/216 LP; 51/235; 269/21

[58] Field of Search ..... 51/235, 216 LP, 229; 269/21

[56] References Cited

U.S. PATENT DOCUMENTS

| | | | |
|---|---|---|---|
| 2,437,436 | 3/1948 | Mullen | 51/235 UX |
| 3,134,208 | 5/1964 | Richmond | 51/235 |
| 3,461,622 | 8/1969 | Rayford | 51/229 |
| 3,834,085 | 9/1974 | Moeller | 51/229 |
| 3,962,833 | 6/1976 | Johnson | 51/216 LP |

*Primary Examiner*—Harold D. Whitehead
*Attorney, Agent, or Firm*—Warren F. B. Lindsley

[57] ABSTRACT

Apparatus for holding gem stones during machining, grinding and the like employing a chucking device utilizing a combination of vacuum and adhesive means to provide a firm holding means for the gem.

2 Claims, 4 Drawing Figures

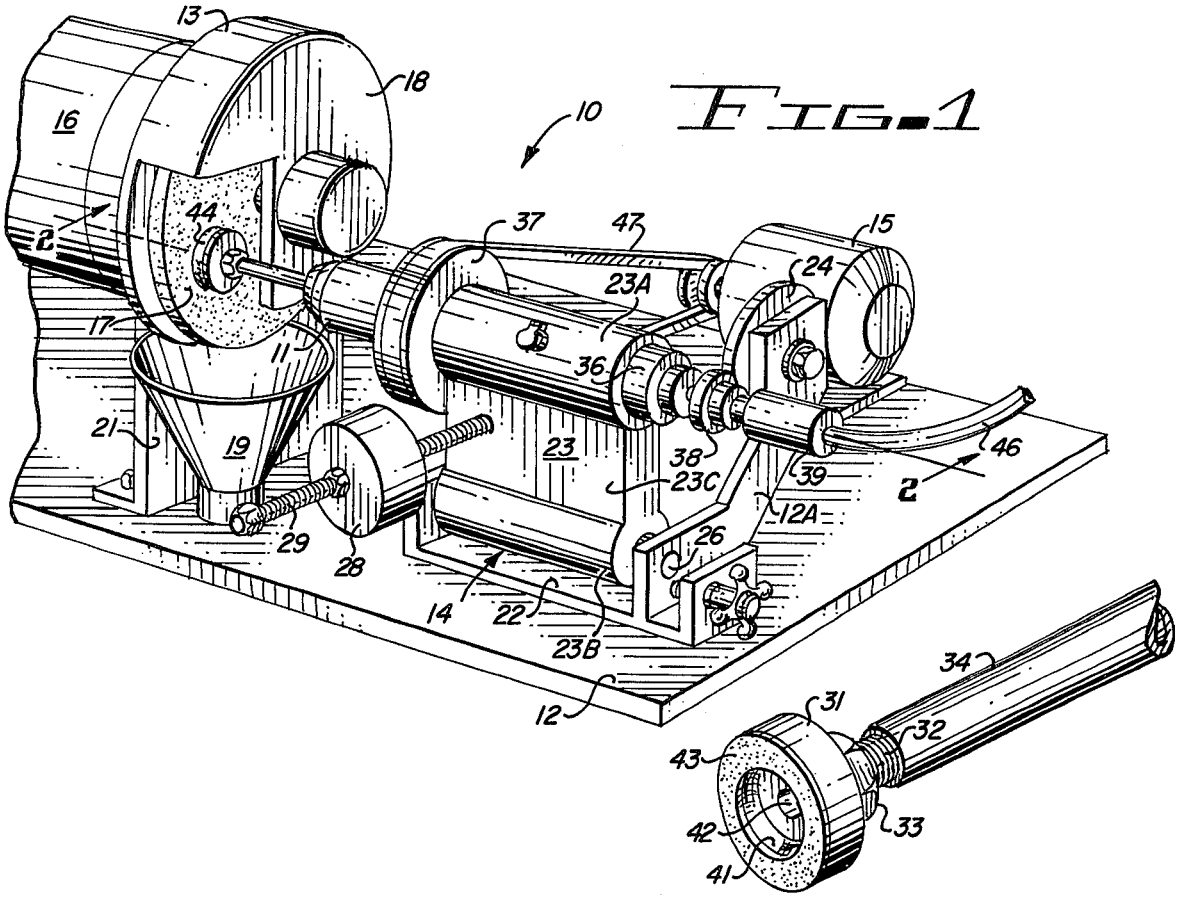
FIG. 1
FIG. 3
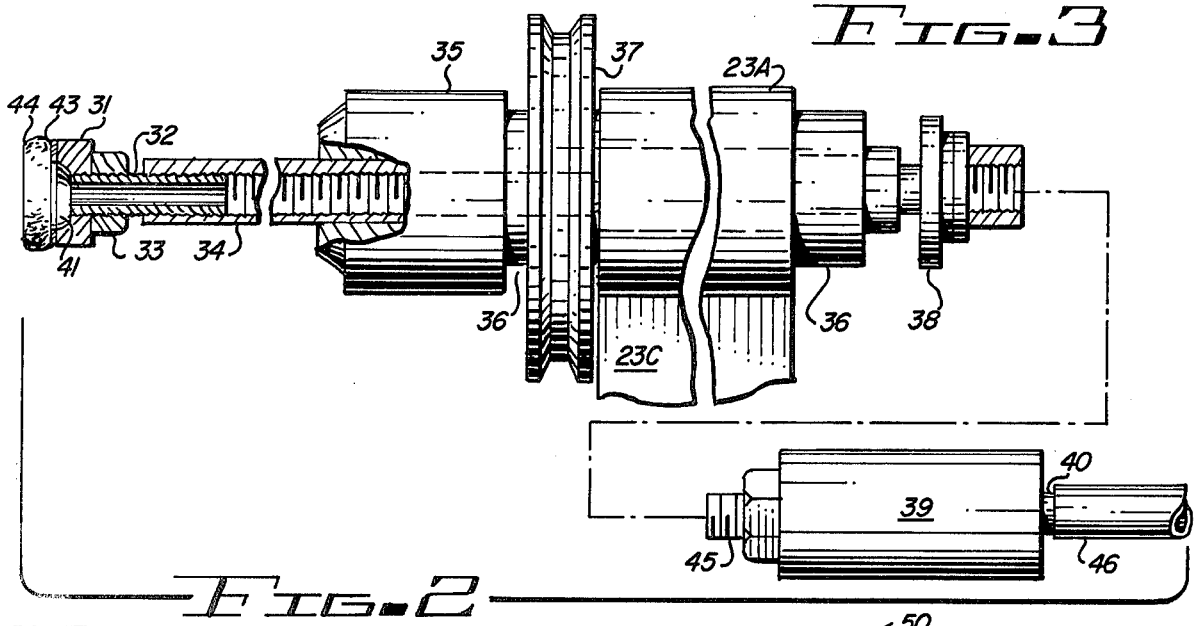
FIG. 2
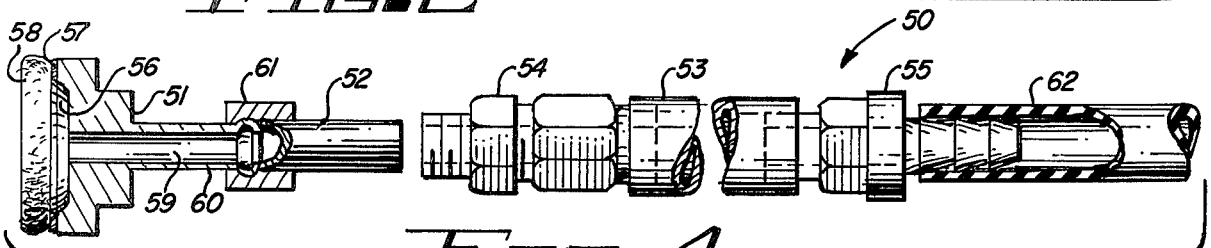
FIG. 4

HOLDING MEANS FOR GEM STONES

BACKGROUND OF THE INVENTION

This invention relates to machinery for holding parts such as gem stones during machining, grinding and like operations and more particularly to chucking means employing a combination of vacuum and adhesive means for holding the gem stones.

DESCRIPTION OF THE PRIOR ART

Various means utilizing a vacuum to secure a gem or other object while it is polished or ground have been described in the prior art including disclosures by Richardson (U.S. Pat. No. 2,444,531), Rocher et al. (U.S. Pat. No. 3,274,737), Kraissl, Jr. (U.S. Pat. No. 3,721,465), and Coburn et al. (U.S. Pat. No. 3,794,314). Kraissl discloses such a means for holding gems or other objects in a fixed position while they are ground or polished. Richardson, Rocher and Coburn disclose rotation of vacuum-held articles. Resilient seals are employed at the point of contact between the holding means and the object being held.

The resilient seal employed in the prior art has not proved entirely satisfactory. In the grinding and polishing of the cabochon the lateral or side pressure tends to move the stone from its initial position, frequently breaking the vacuum seal and causing it to be dislodged entirely. On an automatic cabochon machine the position of the gem on the holding piece must be held very rigidly and precisely. This is not possible to achieve using a resilient seal. Furthermore, the soluble oil and water washes employed in the grinding and polishing operations tend to produce lateral slipping of the stone or gem relative to the resilient seal.

Clearly an improved holding means incorporating the convenience of the vacuum method but overcoming the problems associated with the resilient seal is much to be desired.

SUMMARY OF THE INVENTION

In accordance with the invention claimed an improved apparatus is provided for holding a gem or stone in position on a rotating stock during the grinding and polishing operations, the apparatus incorporating a combination of a vacuum and an adhesive surface to afford a more stable and secure holding action than was possible with the prior art devices.

It is therefore one object of this invention to provide an improved apparatus for holding a gem or stone in position during grinding and polishing operations.

Another object of this invention is to provide such an apparatus with a capability for securely holding the stone in position in the presence of the lateral or side pressures experienced during such operations.

A further object of this invention is to provide such an apparatus with a capability for maintaining precisely the exact initial position of the stone on the holding piece in spite of the side or lateral pressures experienced.

A still further object of this invention is to provide such an apparatus with a capability to hold the stone or gem rigidly in position without vibration or momentary deflection during the grinding operation.

A still further object of this invention is to accomplish the foregoing objectives while working with stones of irregular shapes, contours and varying degrees of hardness and porosity.

A still further object of this invention is to provide such an improved apparatus while retaining the convenience of the prior art vacuum means but eliminating the problems and shortcomings associated with the resilient seal heretofore employed therein:

BRIEF DESCRIPTION OF THE DRAWINGS

The present invention may be more readily described by reference to the accompanying drawing in which:

FIG. 1 is a perspective view of a cabochon machine in which the improved holding apparatus of the invention has been installed;

FIG. 2 is an enlarged view of a portion of the machine of FIG. 1 showing in greater detail the improved holding apparatus of the invention as viewed along line 2—2 of FIG. 1;

FIG. 3 is a close-up perspective view of the vacuum cup with its adhesive surface which serves as the holding means proper; and FIG. 4 is a side view of a hand-held apparatus for holding a gem or stone against a grinding or polishing wheel, the apparatus again incorporating the vacuum and adhesive holding means of the invention.

DESCRIPTION OF THE PREFERRED EMBODIMENT

Referring more particularly to the drawing by characters of reference, FIG. 1 discloses a cabochon machine 10 incorporating the improved holding apparatus 11 of the invention, the machine 10 comprising a flat mounting plate 12, a separately supported grinding wheel assembly 13, a tilting spindle assembly 14 and a spindle drive motor 15.

The grinding wheel assembly 13 comprises a drive motor 16, a disc-shaped grinding wheel 17, a guard or shroud 18 which covers the wheel 17 except for the working area, and a funnel-shaped reservoir 19 which collects material ground from the stone along with grinding fluids which are washed over the grinding surfaces. The wheel 17 is mounted directly to the shaft of the motor 16 which is supported from the plate 12 by a bracket 21.

The spindle assembly 14 comprises a supporting frame 22 which mounts on plate 12, a tilting spindle support 23, an idler wheel 24 and the holding apparatus 11 which incorporates the rotating spindle itself.

Spindle support 23 has an upper cylindrical housing 23A which rotatably supports and houses the holding apparatus 11 and it has a parallel lower cylindrical housing 23B which carries the pivot pin 26 by means of which support 23 is pivotally secured to frame 22. A web 23C joins housings 23A and 23B.

The idler wheel 24 has its rotational axis supported by a frame member 12A which extends laterally and upward from the lower position of frame 12.

An adjustable balance weight 28 extends perpendicularly from web 23C in a direction opposite the extension of member 12A so that the weight of balance weight 28 produces a pivotal force about pin 26 in a direction opposite the moment produced by the weight of idler wheel 24 and member 12A. Weight 28 is in the form of a solid cylinder with an axial threaded bore. It is threadably mounted on a threaded stud 29 which is perpendicularly attached to web 23C. The rotational moment produced by weight 28 is adjusted by rotation to change its position along stud 29.

The holding apparatus 11 as shown in FIGS. 1-3 comprises a vacuum cup 31, a slender threaded nipple 32, a locking nut 33, a hollow cylindrical shaft 34, a chuck 35, a main spindle 36, pulley 37, a cam 38, a rotary union 39 and a vacuum hose coupler 40.

Vacuum cup 31 is in the form of a short cylinder having a shallow central depression 41 at its forward end which is in communication with a threaded axial bore 42, the bore 42 extending to the opposite rearward face of cup 31. The depression 41 does not extend to the circumference of the forward face of cup 31 but leaves a disc-shaped planar surface about its periphery to which is secured a disc-shaped adhesive tape 43. The tape 43 is of the "double-sided" variety, i. e. it has adhesive on both its front and back surfaces so that one adhesive surface serves to attach the tape 43 to the cup 31 and the other adhesive surface is employed for the securing of the stone or gem 44 which is to be ground or polished by the machine 10. Cup 31 is threadably attached to one end of nipple 32 and is locked in position thereon by means of locking nut 33 which is also turned over nipple 32 and tightened against the rearward surface of cup 31.

Shaft 34 has a threaded inside bore which threads over the outer surface of the rearward end of nipple 32. The opposite end of shaft 34 is gripped by chuck 35 which is integral with main spindle 36 and with pulley 37 which is located just rearward of chuck 35 and immediately forward of the entry of spindle 36 into housing 23A.

Attached to the rearward end of spindle 36 at its point of emergence from housing 23A is the cam 38. Cam 38 is detachable from spindle 36 and is provided in various sizes so that an appropriate cam 38 may be selected or fabricated for a particular grinding operation.

The rotary union 39 is threadably attached by means of a coupler 45 to the rearward end of the cam 38. Union 39 incorporates interior O-ring seals which permit rotation of its forward coupler 45 relative to the hose coupler 40 which extends from its rearward end.

The cup 31, nipple 32, shaft 34, chuck 35, pulley 37, spindle 36, cam 38, union 39 and coupler 40 are all coaxial and are penetrated by a common central opening which extends from the coupler 40 to the depression 41 in the forward face of cup 31. The common opening is substantially air-tight so that a partial vacuum may be effected therein by the attachment of a vacuum hose 46 to coupler 40. By virtue of the rotational seal afforded by union 39 the vacuum is sustained as spindle 36 is rotated when pulley 37 is coupled to drive motor 15 my means of a belt 47. The vacuum thus produced inside depression 41 in cooperation with the adhesive tape 43 affixed to the forward face of cup 31 secures a stone or gem 44 in position at the forward end of cup 31.

The axis of the spindle 36 is parallel with the axis of grinding wheel 17 so that the forward surface of the gem 44 impinges directly against the rearward face of wheel 17. The face of wheel 17 is typically contoured in annular patterns so that as both the wheel 17 and the gem 44 are rotated about their individual axes and as the gem 44 is progressively moved closer to the rotational axis of wheel 17 by the pivotal action of support 23, the face and peripheral surfaces of the gem 44 are ground and polished to the desired contours.

The detailed operation and the manner of controlling the machine 10 during such operations is more fully described in a copending application by the inventor of the present disclosure. Of particular interest here, however, are the lateral forces experienced by the rotating gem 44 as it impinges against the abrasive surface of wheel 17. Irregularities in the composition and hardness of the gem 44 aggravated by vibrational tendancies of the machine 10 require that the stone or gem be securely held in position to prevent it from being displaced or dislodges from its desired centered position on the face of cup 31. Furthermore, the gem must be rigidly secured to prevent its vibrational movement about its fixed position to permit a smooth grinding action.

These difficult and important mounting requirements are achieved through the use of very thin adhesive tapes which may be, for example, as thin as six thousandths of an inch and formed of suitable plastic vinyl material. A considerably more rigid and secure holding action is obtained by the combined action of the vacuum and the adhesive than was heretofore possible with the use of resilient seals. Furthermore, the adhesives are not soluble or penetrable by the oils and other liquids which are washed over the grinding surfaces so that the loss of friction experienced in the presence of such fluids by the resilient seals is not experienced in connection with the adhesive surfaces utilized in the present invention.

FIG. 4 shows a second embodiment of the invention as applied to a hand-held tool 50, the tool 50 comprising a detachable cup 51, a metal tube 52, a nylon or composition tube 53 and couplers 54 and 55.

The cup 51 is similar to the cup 31 of FIGS. 1–3. It has a forward depression 56 surrounded by an adhesive 57 against which the gem or stone 58 is secured. A central bore 59 extends from the center of the depression 56 to the rear of a hollow shaft 50 extending rearwardly from cup 51.

The rearward end of shaft 60 is detachably connected to the forward end of tube 52 where a compression fitting 61 is provided for this purpose.

Tube 53 is of suitable diameter and surface finish to be conveniently gripped by the hand during the grinding operation. Its forward end is attached to tube 52 by means of fitting 54 and its rearward end carries fitting 55 which is provided for coupling to a vacuum hose 62. The vacuum from hose 62 is carried to the depression 56 of cup 51 through the hollow interiors of coupling 55, tube 53, coupling 54, tube 52 and shaft 60. The holding action afforded by the combination of the vacuum and the adhesive 57 is identical to that provided in the arrangement of FIGS. 1–3.

An improved apparatus for securing a gem or stone to a rotating spindle or to a hand-held tool is thus provided in accordance with the stated objects of the invention. Although but two embodiments of the invention have been illustrated and described it will be apparent to those skilled in the art that various changes and modifications may be made therein without departing from the spirit of the invention or from the scope of the appended claims.

I claim:

1. A vacuum chucking means for securing a work piece therein comprising:

a hollow cylindrical member, said member defining a cup shaped depression at open end, the periphery of said depression forming a circular plane ring shaped surface, a relatively thin double surfaced adhesive vinyl tape means formed from a water and oil insoluble material having one of its surfaces secured to said ring shaped surface, the other of said surfaces of said adhesive vinyl tape means being provided for engaging and holding a work piece, and means for partially evacuating the space within said cup shaped depression through said hollow cylindrical member, whereby the combined effect of said adhesive means and said evacuating means firmly holds the work piece when moved against a work forming tool, a first means for rotating said cylindrical member, a second means for selectively moving the axis of said cylinder to a number of different parallel positions while in contact with a work forming tool and in conjunction with the operation of said evacuating means, and cam means for bearing against said cylindrical member for selectively varying the different parallel positions of said cylindrical member against the work forming tool.

2. The vacuum chucking means set forth in claim 1 wherein:

said tape is approximately six thousandths of an inch thick.

* * * * *